US005924170A

United States Patent [19]

Papke et al.

[11] Patent Number: 5,924,170

[45] Date of Patent: Jul. 20, 1999

[54] VEHICLE DOOR HINGE WITH REMOVABLE DETENT MECHANISM

[75] Inventors: Ronald D. Papke, Shelby Township, Mich.; Eric V. Kalliomaki, Markham, Canada; Patrick Davis, Fenton, Mo.; Michael Kowalczyk, Sterling Heights, Mich.; Henri Thibault, Harrow; Kenneth Crooks, Belle River, both of Canada; Ronald J. Miller, Berlin; Michael G. Gawronski, Clarkston, both of Mich.; Roland C. James, Newmarket, Canada; Mark O. Minty, Shelby Township, Mich.

[73] Assignees: Chrysler Corporation, Auburn Hills, Mich.; Multimatic, Inc., Markham, Canada

[21] Appl. No.: 08/925,829

[22] Filed: Sep. 5, 1997

[51] Int. Cl.[6] ..... E05D 11/10; E05F 5/02

[52] U.S. Cl. ..... 16/321; 16/82; 16/334

[58] Field of Search ..... 16/82, 86 R, 86 A, 16/321, 334

[56] References Cited

U.S. PATENT DOCUMENTS

| | | | |
|---|---|---|---|
| 1,564,611 | 12/1925 | Mountford et al. | 16/334 |
| 1,589,613 | 6/1926 | Mountford et al. | 16/334 |
| 1,687,174 | 10/1928 | Mountford et al. | 16/334 |
| 1,745,773 | 2/1930 | Sipe | 16/86 A |
| 2,201,594 | 5/1940 | Sitts | 16/82 |
| 3,550,187 | 12/1970 | Swartz | 16/278 |
| 4,670,941 | 6/1987 | Peterson | 16/334 |
| 4,800,624 | 1/1989 | Whitefoot et al. | 16/86 A |
| 4,831,688 | 5/1989 | Deininger | 16/82 |
| 4,891,862 | 1/1990 | Holan | 16/334 |
| 5,027,471 | 7/1991 | Barnes | 16/82 |
| 5,092,017 | 3/1992 | Hatano et al. | 16/2 |
| 5,426,819 | 6/1995 | Rohn | 16/82 |
| 5,577,295 | 11/1996 | Papke et al. | 16/254 |

FOREIGN PATENT DOCUMENTS

| | | | |
|---|---|---|---|
| 1071203 | 6/1967 | United Kingdom | 16/334 |

*Primary Examiner*—Brian K. Green
*Assistant Examiner*—Marcus Dolce
*Attorney, Agent, or Firm*—William J. Coughlin

[57] ABSTRACT

A removable detent mechanism to be utilized with a vehicle door hinge assembly for providing a temporary door check mechanism during painting of the vehicle body and door assembly. The detent mechanism is positioned between the door hinge pin and the vehicle hinge bracket. An interference lobe formed on the detent mechanism is engageable with a portion of the door hinge bracket to generate a detent force during the opening and closing of the door assembly relative to the vehicle body. The removable detent mechanism is provided with local stiffness features which enable adjustment of the detent force.

17 Claims, 2 Drawing Sheets

VEHICLE DOOR HINGE WITH REMOVABLE DETENT MECHANISM

TECHNICAL FIELD

This invention relates generally to a vehicle door hinge assembly and more particularly to a removable detent mechanism for positioning and holding a vehicle door in an open position in relation to the vehicle body.

BACKGROUND OF THE INVENTION

Generally, in the process of manufacturing a vehicle, the vehicle body and doors are painted simultaneously. In this manner, the door assemblies are fitted onto the door hinges and positioned in proper vehicle orientation. Subsequently, during the painting process, the door assemblies are repeatedly opened and closed to permit access to all of the surfaces to be painted by the painting equipment. During some of these operations, the vehicle doors must be positioned and retained in the open position. Altemately, other operations require that the vehicle doors be positioned and retained in the closed position. Accordingly, the door assemblies must be equipped with means for releasably positioning and retaining the doors in the open or closed position.

Heretofore, difficulties have been encountered in equipping the door assemblies with a suitable detent mechanism. More particularly, due to the overspray of the paint and other adverse environmental conditions, the production check strap assemblies cannot be utilized. Accordingly, temporary check strap fixtures have been utilized. More particularly, a multiple piece check strap assembly is secured to the door assembly and operably coupled to the vehicle body. The temporary check strap fixture provides a detent for the door assembly between an open and closed position. Upon completion of the painting process, the temporary check strap fixture is uncoupled from the body, the door assemblies are removed from the vehicle body and then the temporary check strap fixture is removed from the door assembly. Since each temporary check strap fixture is fairly costly, they are reconditioned by removing excess paint from the fixture and recycled for use again on other vehicle bodies. Thus, these temporary check strap fixtures are costly in design, in installation, and in maintenance.

DISCLOSURE OF THE INVENTION

A general object of the present invention is to provide a vehicle door hinge with removable detent mechanism for use during the painting process of the vehicle body and door assemblies.

Another object of the invention is to provide a removable hinge detent mechanism which is simple in design, easy to install, and disposable or readily recyclable.

A further object of the present invention is to provide a removable hinge detent mechanism operably coupled to the vehicle door hinge assembly to expedite installation and removal of the temporary fixture during the painting and assembly processes.

Still another object of the present invention is to provide a removable hinge detent mechanism which is readily adaptable to a variety of door and hinge assemblies such that the force required to open and close the vehicle door can be matched with the geometry of the door assembly and vehicle door hinge assembly.

These and other objects and advantages will become more apparent when reference is made to the following drawings and accompanying description.

BEST MODE OF CARRYING OUT THE INVENTION

Figure 1:
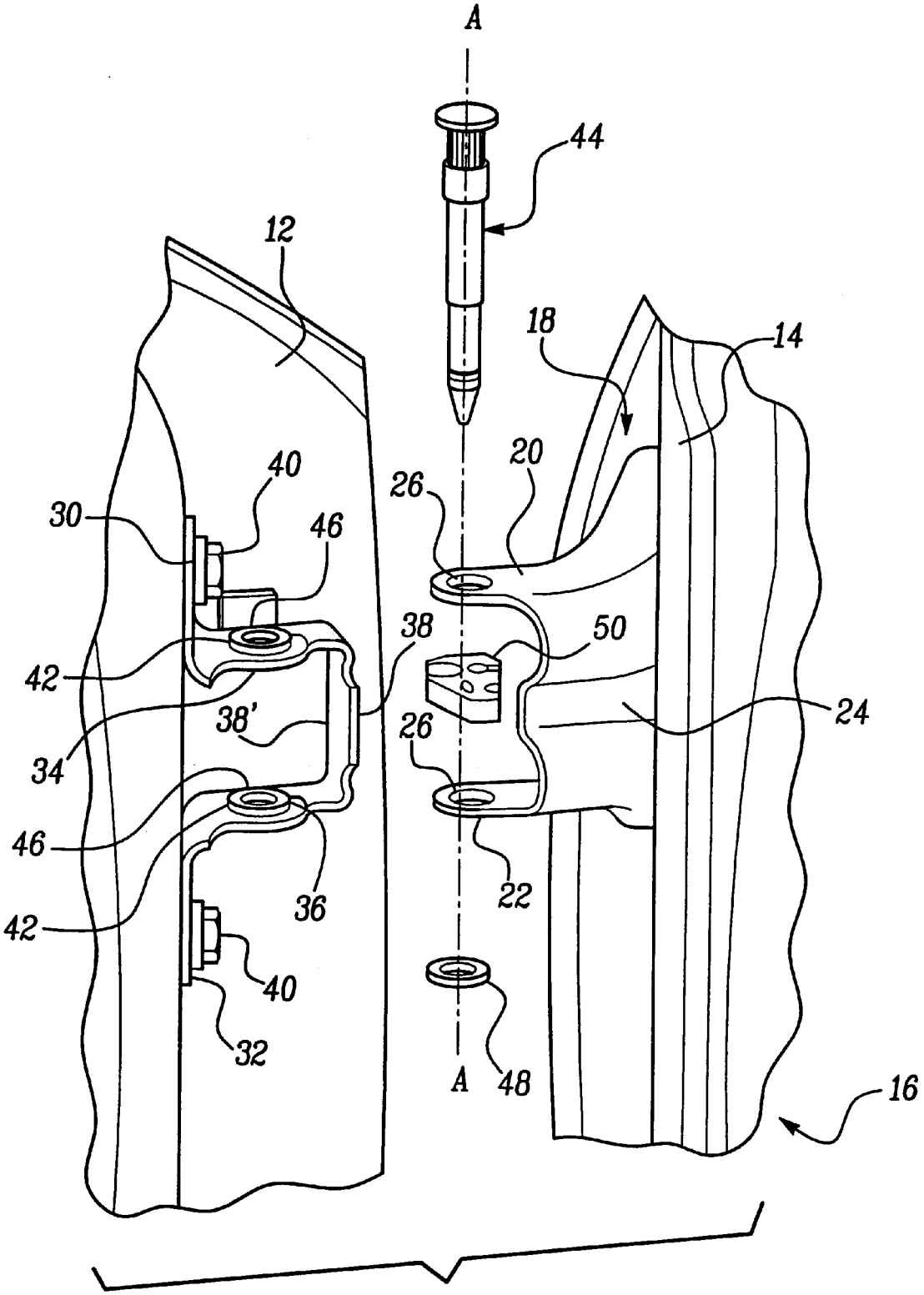
FIG. 1 is an exploded perspective view of a vehicle body, door assembly and door hinge assembly having the removable detent mechanism of the present invention incorporated therein.
Figure 2:
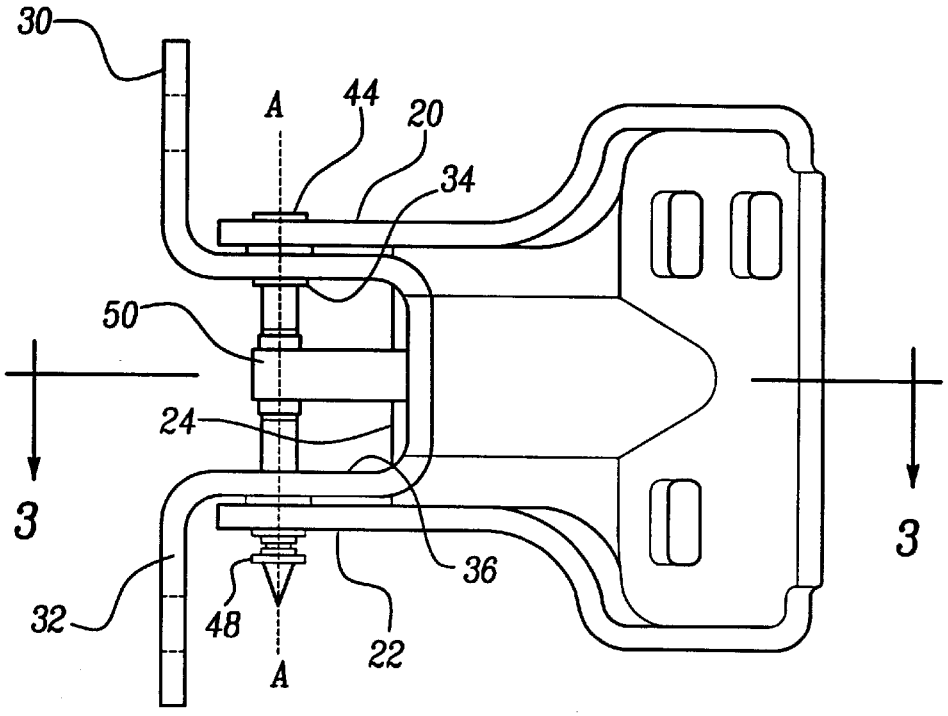
FIG. 2 is a side elevational view of the vehicle door hinge assembly.

Referring now to the drawings in greater detail, FIG. 1 and FIG. 2 illustrate a vehicle door hinge assembly 10 operably interconnecting a door 12 to a pillar 14 of vehicle body 16. Vehicle door hinge assembly 10 includes vehicle hinge bracket 18 secured by bolts (not shown) to pillar 14. Upper and lower horizontal legs 20 and 22, respectively, extend outwardly from vehicle hinge bracket 18. Web portion 24 extends between horizontally extending legs 20 and 22. Vertically aligned holes 26 are formed in legs 20 and 22. Vehicle door hinge assembly 10 further includes door hinge bracket 28 which is generally U-shaped with mounting flanges 30 and 32 formed on the ends of legs 34 and 36, respectively. Vertical flange 38 interconnects horizontally extending legs 34 and 36. Mounting flanges 30 and 32 are secured to door 12 by bolts 40. Vertically aligned holes 42 are formed through upper and lower legs 34 and 36. The spacing between upper and lower legs 20 and 22 and upper and lower legs 34 and 36 is such that door hinge bracket 28 mounts inside vehicle hinge bracket 18 when door 12 is appropriately positioned relative to vehicle body 16. Holes 26 and 42 are substantially vertically aligned during the door mounting process.

Hinge pin 44 extends downwardly through holes 26 and 42 to maintain a relatively tight fitting pivotal relationship between door 12 and vehicle body 16. An end of hinge pin 44 is adapted to receive C-ring 48 after assembly, as shown in FIG. 2. As such, door hinge bracket 28 rotates about longitudinal axis A—A of hinge pin 44. Clearance radius r is defined by the distance between longitudinal axis A—A and the inner surface 38' of vertical flange 38. Suitable bushings 46 may be mounted in hole 42 to facilitate pivotal motion of door hinge bracket 28 about hinge pin 44. As presently preferred, hinge assembly 10 accommodates a three diameter hinge pin of the type disclosed in U.S. Pat. No. 5,577,295 entitled "Three Diameter Hinge Pin" which is commonly owned by the assignee of the present invention and the disclosure of which is expressly incorporated by reference herein. As previously discussed, it is desirable to provide a removable hinge detent mechanism with vehicle door hinge assembly 10 for use during the painting process of door 12 and vehicle body 16. In this regard, vehicle door hinge assembly 10 further includes detent mechanism 50 detachably secured to hinge pin 44 in between upper and lower horizontal legs 20 and 22 of vehicle hinge bracket 18 and upper and lower horizontal legs 34 and 36 of door hinge bracket 28.

Figure 3:
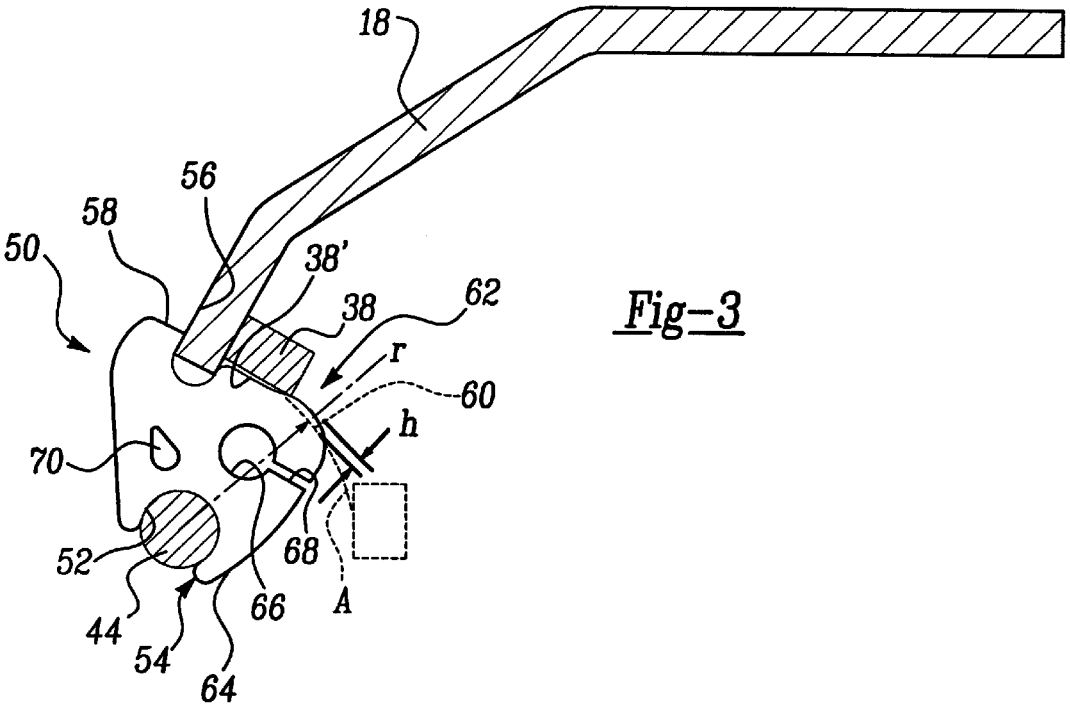
FIG. 3 is a cross sectional view taken along line III—III shown in FIG. 2 illustrating the vehicle door hinge assembly.

Referring now to FIG. 3, detent mechanism 50 is generally triangularly shaped and has a first arcuate recess 52 formed at apex 54 thereof for receiving hinge pin 44. As best seen in FIG. 3, arcuate recess 52 extends for approximately two hundred and fifty degrees (250°) for adequately interlocking detent mechanism 50 with hinge pin 44. Groove 56 is formed in side 58 opposite arcuate recess 52 and receives an edge portion of web 24 formed in vehicle hinge bracket 18. Once detent mechanism 50 is properly positioned between hinge pin 44 and web 24, detent mechanism 50 is constrained against rotation during opening and closing of door 12.

Detent mechanism 50 further includes interference lobe 60, a curved surface transitioning from groove 56 along side 58 to apex 62, then transition from apex 62 along side 64 to apex 54 and further defined by the portion of detent mechanism 50 outside the area circumscribed by arc A having a radius equal to clearance radius r about longitudinal axis A—A of hinge pin 44. Interference lobe 60 frictionally engages flange 38 to generate a detent force during pivotal movement of door hinge bracket 28 about hinge pin 44. More specifically, inner surface 38' of flange 38 engages interference lobe 60 as door 12 swings from the closed position (shown in phantom lines in FIG. 3) into the open position (shown in solid lines in FIG. 3), thereby providing a detent for holding door 12 in the open position. The amount of force, i.e., the detent force, required to manipulate door 12 between the open position and the closed position is dependent upon the amount of interference between flange 38 and interference lobe 60, the local stiffness of detent mechanism 50 at interference lobe 60, as well as the durometer of detent mechanism 50.

The amount of interference between inner surface 38' and interference lobe 60 is defined by the height h of interference lobe 60, i.e., the radial distance from arc A to the edge of interference lobe 60. As presently preferred, the height h of interference lobe 60 is approximately 0.9 millimeters. The local stiffness of detent mechanism 50 at interference lobe 60 is a function of the structural features formed therein. For example, throughbore 66 is formed within the interior volume defined by detent mechanism 50 adjacent interference lobe 60. As presently preferred, throughbore 66 is a 7 millimeter diameter hole. Additionally, slot 68 is formed in detent mechanism 50 for further reducing the local stiffness of detent mechanism 50 at interference lobe 60. Slot 68 provides the additional benefit of reducing the stress induced in detent mechanism 50 during manipulation of door hinge bracket 28. Pocket 70 is formed in detent mechanism 50 to maintain an approximately constant section throughout detent mechanism 50, thus improving the molding of detent mechanism 50.

As presently preferred, detent mechanism 50 is manufactured from a mineral reinforced nylon resin having a flexural modulus of approximately 5100 MPa, thereby providing adequate stiffness and durability characteristics in addition to providing the desirable frictional characteristics. A presently preferred material, Minlon® 11C40 BK121, is available from DuPont Canada, Inc.

While the present invention has been described in reference to a particular preferred embodiment, one skilled in the art would readily recognize that certain modifications could be made thereto without deviating from the scope of the present invention. For example, the interference between detent mechanism 50 and flange 38 could be increased or decreased depending upon the desirable detent force. Similarly, other local stiffness increasing or decreasing features could be incorporated into detent mechanism 50 for adjusting the detent force. Likewise, other suitable materials could be utilized.

While but one embodiment of the present invention has been shown and described, other modifications thereof are possible within the scope of the following claims.

We claim:

1. In a vehicle door hinge assembly used for operably coupling a door assembly to a vehicle body, said door hinge assembly having a vehicle hinge bracket secured to said vehicle body, a door hinge bracket secured to said door assembly, and a hinge pin pivotally coupling said door hinge bracket to said vehicle hinge bracket, the improvement comprising a detent mechanism removably interconnected between said hinge pin and said vehicle hinge bracket, said detent mechanism having an interference lobe formed thereon engageable with a portion of said door hinge bracket to generate a detent force during pivotal movement of said door assembly relative to said vehicle body, said detent mechanism further having an arcuate recess formed therein for receiving said hinge pin and a groove formed therein for engaging a portion of said vehicle hinge bracket.

2. The vehicle door hinge assembly of claim 1 wherein said detent mechanism further comprises means for locally reducing the stiffness of said detent mechanism at said interference lobe.

3. The vehicle door hinge assembly of claim 2 wherein said means for locally reducing the stiffness comprises said detent mechanism having a throughbore formed therein.

4. The vehicle door hinge assembly of claim 2 wherein said means for locally reducing the stiffness comprises said detent mechanism having a slot formed therein.

5. The vehicle door hinge assembly of claim 2 wherein the cross-sectional area of said detent mechanism is approximately constant.

6. The vehicle door hinge assembly of claim 1 wherein said detent mechanism is manufactured from a mineral reinforced nylon resin.

7. A vehicle door hinge assembly comprising:

a vehicle hinge bracket;

a door hinge bracket;

a hinge pin operably coupling said door hinge bracket to said vehicle hinge bracket to permit free pivotal movement of said door hinge bracket relative to said vehicle hinge bracket; and a detent mechanism having an interference lobe formed thereon, said interference lobe engageable with a portion of said door hinge bracket to generate a detent force during pivotal movement of said door hinge bracket relative to said vehicle hinge bracket;

said vehicle hinge bracket having a pair of horizontally extending legs and a web portion interconnecting therebetween, each of said horizontally extending legs having a hole formed therein for receiving said hinge pin; and said detent mechanism having an apex formed thereon, an arcuate recess formed in said apex for removable receiving said hinge pin, a side opposite said apex and a groove formed in said side opposite said apex for engaging said web portion of said vehicle hinge bracket.

8. The assembly of claim 7 wherein said detent mechanism is generally triangular in shape.

9. The vehicle door hinge assembly of claim 7 wherein said door hinge bracket is a generally U-shaped door hinge bracket having a pair of horizontally extending hinge bracket legs and a flange portion extending therebetween, said flange portion having an inner surface formed thereon, each of said horizontally extending hinge bracket legs having a hole formed therein for receiving said hinge pin, and further wherein said detent mechanism is removably positioned on said hinge pin such that said interference lobe is engageable with said inner surface during pivotal movement of said door hinge bracket relative to said vehicle hinge bracket.

10. The vehicle door hinge assembly of claim 9 wherein said detent mechanism further comprises means for locally reducing the stiffness of said detent mechanism at said interference lobe.

11. The vehicle door hinge assembly of claim 10 wherein said means for locally reducing the stiffness comprising said detent mechanism having a throughbore formed therein.

12. The vehicle door hinge assembly of claim 10 wherein said means for locally reducing the stiffness comprising said detent mechanism having a slot formed therein.

13. The vehicle door hinge assembly of claim 10 wherein the cross-sectional area of said detent mechanism is approximately constant.

14. The vehicle door hinge assembly of claim 7 wherein said detent mechanism is manufactured of a mineral reinforced nylon resin.

15. A vehicle door hinge assembly comprising:

a vehicle hinge bracket;

a door hinge bracket;

a hinge pin operably coupling said door hinge bracket to said vehicle hinge bracket to permit free pivotal movement of said door hinge bracket relative to said vehicle hinge bracket; and a detent mechanism having an interference lobe formed thereon, said interference lobe engageable with a portion of said door hinge bracket to generate a detent force during pivotal movement of said door hinge bracket relative to said vehicle hinge bracket, said detent mechanism defining an arcuate recess releasably receiving said hinge pin;

wherein said detent mechanism further includes a groove formed therein for engaging a portion of said vehicle hinge bracket.

16. The vehicle door hinge assembly of claim 15, wherein said vehicle hinge bracket has a pair of horizontally extending legs and a web portion interconnecting therebetween, each of said horizontally extending legs having a hole formed therein for receiving said hinge pin.

17. A vehicle door hinge assembly comprising:

a vehicle hinge bracket;

a door hinge bracket;

a hinge pin operably coupling said door hinge bracket to said vehicle hinge bracket to permit free pivotal movement of said door hinge bracket relative to said vehicle hinge bracket; and a detent mechanism having an interference lobe formed thereon, said interference lobe engageable with a portion of said door hinge bracket to generate a detent force during pivotal movement of said door hinge bracket relative to said vehicle hinge bracket, said detent mechanism defining an arcuate recess releasably receiving said hinge pin;

wherein said vehicle hinge bracket has a pair of horizontally extending legs and a web portion interconnecting therebetween, each of said horizontally extending legs having a hole formed therein for receiving said hinge pin.

* * * * *